United States Patent [19]

Suga et al.

[11] 4,150,993

[45] Apr. 24, 1979

[54] PROCESS FOR FORMING A DIRECT POSITIVE IMAGE

[75] Inventors: Tsuneo Suga; Keiji Ogi; Kenji Egami, all of Hino, Japan

[73] Assignee: Konishiroku Photo Industry Co., Ltd., Tokyo, Japan

[21] Appl. No.: 853,103

[22] Filed: Nov. 21, 1977

[30] Foreign Application Priority Data

Nov. 25, 1976 [JP] Japan ..... 51/142026

[51] Int. Cl.[2] ..... G03C 5/24

[52] U.S. Cl. ..... 96/64; 96/95; 96/107

[58] Field of Search ..... 96/64, 59, 107, 109, 96/101, 95

[56] References Cited

U.S. PATENT DOCUMENTS

| | | | |
|---|---|---|---|
| 3,361,564 | 1/1968 | Bigelow et al. | 96/101 |
| 3,647,450 | 3/1972 | Calligaris et al. | 96/66 R |
| 3,734,738 | 5/1973 | Kurtz et al. | 96/64 |
| 3,850,638 | 11/1974 | Willis et al. | 96/64 |
| 3,957,488 | 5/1976 | Klotzer et al. | 96/64 |
| 4,030,925 | 6/1977 | Leone et al. | 96/64 |

*Primary Examiner*—Travis Brown

*Attorney, Agent, or Firm*—Flynn & Frishauf

[57] ABSTRACT

A process for forming a direct positive image by developing, after imagewise exposure to an internal latent image type light-sensitive silver halide photographic material, with a surface developer for silver halide, which process comprises incorporating at least one fogging agent selected from hydrazine compounds, N-substituted cycloammonium salts and benzimidazole derivatives in combination with an amineborane compound into said light-sensitive silver halide photographic material, said surface developer and/or a treating bath used prior to the treatment by said surface developer.

7 Claims, No Drawings

PROCESS FOR FORMING A DIRECT POSITIVE IMAGE

This invention relates to a process for forming a positive image by using a direct positive type silver halide light-sensitive photographic material. More particularly, this invention relates to a novel fog-inducing agent employed in the process wherein a direct positive image is formed by the treatment with a surface developer in the presence of a fogging agent after imagewise exposure of an internal latent image type silver halide light-sensitive photographic material.

This invention can be applied to processes for ordinary black-and-white photography and color photography as well as to a color diffusion transfer process.

It has heretofore been well known that a direct positive photographic image can be formed by using a silver halide light-sensitive photographic material without any intermediate steps of treatment or any negative photographic images.

The hitherto known processes which have been applied to form a positive image by using a direct positive type silver halide light-sensitive photographic material, excluding special processes, can be classified mainly into the following two types taking their practical usefulness into consideration.

The first type of the processes comprises employing a fogged silver halide emulsion and decaying the fog speck (latent image) at an exposed part by taking advantage of solarization or Herschel effect, etc., to form a positive image after development.

Another type of the processes comprises employing a silver halide emulsion free of fog and carrying out the surface-development after conducting fogging treatment and/or while conducting fogging treatment to form a positive image.

The fogging treatment may be carried out by conducting whole-surface exposure; using a fogging agent; using a strong developer; or heat treatment; etc.

In general, the latter type of the processes shows higher sensitivity as compared with the former, thereby being suitable for applications in which high sensitivity is required.

On the other hand, however, the latter has defects in that the maximum density is low and the minimum density is high, and the stability is poor.

In this technical field, various techniques have heretofore been known. The techniques are disclosed mainly in, e.g., U.S. Pat. Nos. 2,592,250, 2,456,957, 2,497,875, and 2,588,982; British Pat. No. 1,151,363; Japanese Patent Publication No. 27,405/1968; Japanese Provisional Patent Publications Nos. 9,434/1972, 9,677/1972, 32,813/1972, 32,814/1972, 9,727/1973 and 9,717/1973; U.S. Pat. Nos. 3,761,266 and 3,796,577; and Japanese Provisional Patent Publications Nos. 8,542/1975 and 38,525/1975.

By applying these publicly-known processes, a light-sensitive photographic material of relatively high sensitivity as a direct positive type material can be made.

It can hardly be said that the details of the mechanism of the direct positive image formation have heretofore been elucidated definitely. But, the process of the positive image formation may be understood by reference to an article "Internal-Image Desensitization" as discussed in "The Theory of the Photographic Process", third edition, page 161 edited by C. E. Kenneth Mess and T. H. James.

Namely, it is considered that fog nuclei are formed selectively in the surface of the unexposed silver halide grains by surface desensitization due to so-called internal latent image which has been produced inside a silver halide grain and a photographic image is subsequently formed at the unexposed part by usual development.

As the useful fogging agents showing such selectivity for nucleation, hydrazine compounds, reactive N-substituted cycloammonium salts, etc., have publicly been known.

For instance, hydrazine compounds described in U.S. Pat. Nos. 2,563,785 and 2,588,982; naphthylhydrozine sulfonic acid described in U.S. Pat. No. 2,604,700; and sulfomethylhydrazines described in British Pat. No. 1,403,018 are used as the fogging agents. In Japanese Patent Publication No. 17,184/1966, it is described that a color positive image of good quality can be formed by using hydrazide or a hydrazine compound for color diffusion transfer process.

Further, the usefulness as the fogging agents of N-substituted quarternary cycloammonium salts is described in Japanese Provisional Patent Publications Nos. 9,434/1972, 9,677/1972 and Japanese Patent Publication No. 37669/1975, and the usefulness of benzimidazoles is in U.S. Pat. No. 3,850,638.

It is described in Research Disclosure No. 11,347 that the combined use of hydrazine and an N-substituted quarternary salt as well as the separate use thereof is useful for shortening the induction period of development, increasing the maximum density and so on in the developing treatment of a light-sensitive color photographic material for a multiple layer diffusion transfer process in which is used an internal latent image type silver halide emulsion.

However, there remain technical problems to be improved further, in order to apply the direct-positive-image-forming process using these compounds as the fogging agents to various fields of photography.

For example, in such fogging development, the induction period until the beginning of the development is long in comparison with an ordinary development of silver halide grains carrying latent images and accordingly, the development speed is fairly decreased, because the fog nucleation by the fogging agent must occur prior to the development. So, there exist problems as follows: non-uniform development rate is apt to be caused from layer to layer in cases where they are applied to a multiple layer light-sensitive color photographic material in particular. Further, the conventional fogging agents show a relatively low maximum density which is obtained finally.

As for conventional fogging agents, a relatively high concentration of the agent is required to attain the desired fog nucleation. It has been found out that a large amount of the fogging agent migrates to the developer and causes undesirable unevenness of development when a fogging agent is used in such a high concentration, particularly if it is contained in the emulsion. In cases where the development is carried out by using a fogging agent in a high concentration, discoloration is apt to be caused at the non-image background due to the stain by the fogging agent.

Conventionally, the development has been carried out at a high pH value of 12 to 13 or more in order to maintain the fogging action to a desirable extent. However, the development under severe conditions of such a high pH value remarkably accelerates the deterioration of the developing agent or lowers the film properties, e.g., mechanical strength of the light-sensitive photographic material, thus being in no way desirable.

An object of this invention is to solve the above-mentioned problems in the conventional processes to provide a process for forming a direct positive image of good quality.

Another object of this invention is to provide a process for accelerating the fogging development effectively to form a direct positive image of good quality.

A further object of this invention is to provide a process for shortening the induction period of development and producing balanced development rates in all light-sensitive layers to form a good direct positive image having high maximum density and low minimum density.

A still further object of this invention is to provide a process for carrying out an effective fogging development with a low concentration of a fogging agent at a low pH value.

Other objects of this invention will be made clear by the following descriptions.

The present inventors found out that the objects of this invention can be attained by incorporating a borane compound when a direct positive image is formed by development, after imagewise exposure, of an internal latent image type silver halide photographic material in the presence of a fogging agent composed of one or more compounds selected from hydrazine compounds, N-substituted cycloammonium salts and benzimidazole derivatives.

The borane compounds valuable for this invention are amine-boranes represented by formula [I]:

$$Z{:}BH_3 \qquad [I]$$

wherein Z represents an alkylamine or a cyclic amine.

Alkylamine Z represented by formula [II]:

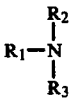

$$R_1-\overset{\overset{R_2}{|}}{\underset{\underset{R_3}{|}}{N}} \qquad [II]$$

wherein $R_1$ is an alkyl group or a hydroxyalkyl group each having 1 to 20 carbon atoms; and $R_2$ and $R_3$ is an alkyl group or a hydroxyalkyl group each having 1 to 20 carbon atoms, or a hydrogen atom, is preferable. As the concrete compounds are exemplified e.g., methylamine, dimethylamine, trimethylamine, ethylamine, ethanolamine, diethylamine, diethanolamine, triethylamine, propylamine, tert-butylamine, diisooctylamine, trioctylamine, dimethyldodecylamine, dimethyloctadecylamine.

As the cyclic amines are exemplified pyridine, picoline, lutidine, 2-ethylpyridine, 2,4-diethylpyridine, morpholine and the like.

According to the process of this invention, the amount of the amine-borane compound to be used for acceleration of fogging development may range widely, preferably between $10^{-5}$ and $10^{-1}$ mole per one mole of the fogging agent. It is surprising that the fogging development of an internal latent image type light-sensitive silver halide photographic material can remarkably be accelerated by using such an extremely small amount of a borane compound in combination with the fogging agent mentioned above to form an excellent positive photographic image. The amine-borane compound may be referred to as a fog-inducing agent, in view of its activity as mentioned above.

As the fogging agent mentioned above to be used in this invention, there may be used wide varieties of compounds.

As the useful fogging agents, there may concretely be exemplified hydrazine compounds such as hydrazine hydrochloride, phenylhydrazine hydrochloride, p-methylsulfonamidoethylphenylhydrazine, 1-formyl-2-phenylhydrazine, 1-acetyl-2-phenylhydrazine, 1-acetyl-2-(4-methylphenyl)hydrazine, 1-acetyl-2-(4-acetamidophenyl)hydrazine, 1-methylsulfonyl-2-phenylhydrazine, 1-benzoyl-2-phenylhydrazine, 1-lauroyl-2-phenylhydrazine, 1-methylsulfonyl-2-(3-phenylsulfonamidophenyl)hydrazine, formaldehydephenylhydrazine, acetone-4-methylphenylhydrazine, 1-sulfomethyl-2-phenylhydrazine, 1-sulfomethylamino-2-phenylhydrazine, etc.; N-substituted quarternary cycloammonium salts such as 3-(2-formylethyl)-2-methylbenzothiazolium bromide, 3-(2-acetylethyl)-2-ethylbenzothiazolium bromide, 3-(2-acetylethyl)-2-benzylbenzothiazolium bromide, 3-(2-formylethyl)-2-propylbenzothiazolium bromide, 5-chloro-3-(2-formylethyl)-2-methylbenzothiazolium bromide, 3-(2-acetylethyl)-2-benzylbenzoselenazolium bromide, 3-(2-acetylethyl)-2-benzyl-5-phenyl-benzoxazolium bromide, 1,2-dihydro-3-methyl-4-phenylpyrido[2,1-b]benzothiazolium bromide, 1,2-dihydro-3-methyl-4-phenylpyrido[2,1-b]-5-phenylhenzoxazolium bromide, 1,2-dihydro-3,4-dimethylpyrido [2,1-b]benzothiazolium bromide, 4,4'-ethylenebis(1,2-dihydro-3-methylpyrido[2,1-b]benzothiazolium bromide), 1,2-dihydro-3-methyl-4-phenylpyrido[2,1-b]benzoselenazolium bromide, etc.; and benzimidazoles such as spiro[benzimidazoline-2,1'-cyclohexane], spiro[5-nitrobenzimidazoline-2,1'-cyclohexane], spiro[benzimidazoline-2,1'-(4-methylcyclohexane)], 1,3-bistrifluoroacetyl-2,3-dihydrobenzimidazole, 5-methoxy-1,3-bistrifluoroacetyl-2,3-dihydrobenzimidazole, 5,6-dimethyl-1,3-bistrifluoroacetyl-2,3-dihydrobenzimidazole, benzimidazoline-2-spiro-1'-cyclohexane-4'-spiro-2''-benzimidazoline, etc.

At least one of the fogging agents of this invention is contained in a layer of silver halide emulsion, a layer adjacent thereto, a developing solution (or a developing agent) or a bath for treatment prior to development, in combination with the amine-borane compound of this invention or separately from the same. Said fogging agent and said amine-borane compound may preferably be contained in the same layer of the layers constituting said light-sensitive silver halide photographic material or in the same solution of said treating solutions.

But they may be contained in the separate layers or in the separate treating solutions; for example, one is contained in a layer constituting the light-sensitive silver halide photographic material and the other is in a treating solution separately, and both are made to cooperate in the steps of processing.

In order to incorporate said fogging agent and said amine-borane compound into the silver halide emulsion, around 50 mg. ~5 g. of the fogging agent per 1 mole of silver halide and the above-mentioned amount of the amine-borane compound may be added at an appropriate time after completion of ripening of the emulsion. When it is added to the developing solution (or the developing agent) or in the treatment bath prior to the development, the amount may preferably be around 0.1~3 g/l.

When the present process is applied to a color diffusion transfer process, they may be incorporated into an image-receiving layer or a sheet. In this case, the amounts of said compounds to be incorporated are approximately the same as those to be incorporated into the layer of silver halide emulsion as mentioned above.

In the usual silver-halide-developing agent to be used in the developing composition of this invention, there may be included hydroquinones, catechols, aminophenols, 3-pyrazolidones, ascorbic acid and its derivatives, reductones, phenylenedimines, etc. and their mixtures. These developing agents may preliminary be incorporated in the emulsion to be reacted with the silver halide during immersion in an aqueous solution of high pH value.

The developing composition employed in this invention may contain further specific antifoggant and development restrainer, or they may optionally be incorporated into a layer film of light-sensitive silver halide photographic material. In the usually useful antifoggants there may be included, for example, benzotriazoles such as 5-methylbenzotriazole; benzothiazoles such as 5-methylbenzothiazole; 1-phenyl-5-mercaptotetrazoles; heterocyclic thiones such as 1-methyl-2-tetrazoline-5-thiones; aromatic and aliphatic mercapto compounds; and so on.

The silver halide emulsion according to this invention is an internal latent image type silver halide emulsion, namely an emulsion which forms a latent image mainly inside the grains of the silver halide or contains silver halide grains having its major sensitivity inside the grains. As the silver halide may be included, for example, silver bromide, silver chloride, silver chlorobromide, silver iodobromide, silver chloroiodobromide, etc.

An emulsion which is preferred in particular is one which shows, when a part of the sample prepared by applying the emulsion on a transparent support is exposed in an intensity scale sensitometor for a certain period of time less than around one second and developed for 4 minutes at 20° C. by using the surface developer A mentioned below which does not substantially contain a silver halide solvent and which develops only the surface image on the grains, a maximum density not more than 1/5 of the maximum density obtained after development for 4 minutes at 20° C. with the internal developer B mentioned below for developing the internal image of the grains after exposure of a different part of the same sample of the emulsion. It is preferable that the maximum density obtained by using the surface developer A is not more than 1/10 of the maximum density obtained with an internal developer.

| | | |
|---|---|---|
| Surface Developer A | | |
| Metal | 2.5 | g. |
| L-ascorbic acid | 10 | g. |
| $NaBO_2 . 4H_2O$ | 20 | g. |
| KBr | 1 | g. |
| Water | to make 1 *l* | |
| Internal Developer B | | |
| Metal | 2.0 | g. |
| sodium sulfite (anhydrous) | 90.0 | g. |
| hydroquinone | 8.0 | g. |
| sodium carbonate monohydrate | 52.5 | g. |
| KBr | 5.0 | g |
| KI | 0.5 | g. |
| Water | to make 1 *l* | |

In the internal latent image type silver halide emulsions according to this invention, there may be included emulsions which are prepared by various processes. There may be mentioned, for instance, a conversion type silver halide emulsion described in U.S. Pat. No. 2,592,250; silver halide emulsions containing silver halide grains sensitized internally and chemically, which emulsions are described in U.S. Pat. Nos. 3,206,316, 3,317,322 and 3,367,778, and Japanese Patent Publication No. 29405/1968; silver halide emulsions containing silver halide grains containing in themselves polyvalent metallic ion, which emulsions are described in U.S. Pat. Nos. 3,271,157, 3,447,927 and 3,531,291; a silver halide emulsion comprising grains having lamination structure, which emulsion is described in Japanese Provisional Patent Publication No. 8524/1975; and a silver halide emulsion containing silver iodide prepared by ammonia process, which emulsion is described in Japanese Patent Application No. 74062/1976.

When a compound having an azaindene ring or an N-containing heterocyclic compound having a mercapto group is added to the silver halide emulsion employed in this invention in an amount of 1 mg.–10 g. per one mole of silver halide, more stable results showing lower minimum density can be given.

As the compound having an azaindene ring, 4-hydroxy-6-methyl-1,3,3a,7-tetrazaindene is preferred. As the rings of the N-containing heterocyclic compounds having an mercapto group thereon, there may be mentioned a pyrazole ring, a 1,2,4-triazole ring, a 1,2,3-triazole ring, a 1,3,4-thiadiazole ring, a 1,2,3-thiadiazole ring, a 1,2,4-thiadiazole ring, a 1,2,5-thiadiazole ring, a 1,2,3,4-tetrazole ring, a pyridazine ring, a 1,2,3-triazine ring, a 1,2,4-triazine ring, a 1,3,5-triazine ring, a ring made by condensation of these 2 or 3 rings, e.g., a triazolotriazole ring, a diazaindene ring, a triazaindene ring, a tetrazaindene ring, a pentazaindene ring, etc., a phthalazinone ring, a indazole ring and the like, 1-phenyl-5-mercaptotetrazole is preferable.

As the antifoggant or the stabilizer in this invention, there may be employed e.g., a mercury compound, a triazole group compound, an azaindene group compound, a benzothiazolium group compound, a zinc compound and so on.

It is optional to add various photographic additives to the silver halide emulsion according to this invention. As the spectral sensitizing dye which may be used in this invention, there may be mentioned cyanines, merocyanines, 3-nucleus or 4-nucleus merocyanines, 3-nucleus or 4-nucleus cyanines, styryls, holopolar cyanines, hemicyanines, oxonols and hemioxonols. These photosensitizers may contain, in a part of the structure of N-containing heterocyclic nucleus, a basic group such as thiazoline, thazole, etc.; a nucleus of rhodanine, thiohydantoin, oxazolidinedione, barbituric acid, thiobarbituric acid, pyrazolone or the like. Such nuclei may be substituted with alkyl, hydroxyalkyl, sulfoalkyl, carboxyalkyl, halogen, phenyl, cyano or alkoxy and may optionally be condensed with a carbon ring or a heterocyclic ring.

The silver halide according to this invention may be super-sensitized. The process for super-sensitization is described in, for example, "Review of Super-sensitization" Phot. Sci. Eng. Vol. 18, No. 4, 418 (1974).

As for the additives which may be employed in this invention in compliance with the purposes, there may be mentioned, for example, dihydroxyalkane as a wetting agent. As a film-property improver, water-dispersible fine grain polymeric substances which are obtained by emulsion polymerization, a copolymer of alkyl acrylate or alkyl methacrylate and acrylic acid or methacrylic acid, a copolymer of styrene and maleic anhydride copolymer, a copolymer of styrene and a half alkyl ester of maleic acid and the like are suitable. As the coating aids may be mentioned, for example, saponin, polyethylene glycol lauryl ether, etc. As other photographic additives may optionally be used gelatin plasticizer, surfactant, ultraviolet rays absorber, pH-adjusting agent, antioxidant, antistatic agent, thickener, granularity improver, dye, mordant, whitening agent, development-speed adjusting agent, matting agent and so on.

Further, it is useful to use the light-sensitive silver halide photographic material of this invention for a color photography. In this case, it is preferable to incorporate a coupler such as cyan, magenta and yellow into the light-sensitive silver halide photographic material. As the coupler, phenols, 5-pyrazolones and ketomethylene compounds are effective, and it is preferable to use the coupler in combination with an active-point-replacing type coupler, a colored coupler or a development inhibiting substance releasing type coupler.

Various supports may be used for the support of the light-sensitive silver halide photographic material according to this invention. As the representative supports, there may be mentioned a polyethylene telephthalate film; a polycarbonate film; a polystyrene film; a polypropyrene film; a cellulose acetate film; glass; a baryta paper; a polyethylene-laminated paper; etc., these being under-coated if necessary.

The light-sensitive silver halide photographic material of this invention may effectively be applied for various uses such as of general black-and-white, X-ray, color, pseudo color, printing, infrared, micro, dye-bleaching by silver and diffusion transfer.

Into the light-sensitive silver halide photographic material of this invention may be incorporated an appropriate gelatin derivative, besides gelatin, in accordance with the purpose. As the appropriate gelatin derivatives, there may be mentioned, for example, an acylated gelatin, a guanidylated gelatin, a carbamylated gelatin, a cyanoethylated gelatin, an esterified gelatin and the like.

Into the photographic material of this invention may be incorporated other hydrophilic binders in accordance with the purpose. As the appropriate binders, there may be mentioned, besides gelatin, a colloidal albumin; agar; gum arabic; dextran; arginic acid; cellulose derivatives such as a cellulose hydrolyzed to contain 19–20% of acetyl group; polyacrylamide; imidated polyacrylamide; casein; a vinyl alcohol copolymer containing urethane carboxylic acid group or cyanoacetyl group, e.g., a copolymer of vinyl alcohol and vinylaminoacetate; polyvinyl alcohol; polyvinylpyrrolidone; a hydrolyzed polyvinyl acetate; a polymer prepared by polymerization between a protein or a protein acylated with a saturated acylating agent and a monomer having a vinyl group; polyvinylpyridine; polyvinylamine; polyaminoethylmethacrylate; polyethyleneamine; etc. These binders may be added to the layers constituting the light-sensitive silver halide photographic material such as emulsion layer, intermediate layer, protecting layer, filter layer, back-coated layer, etc., in accordance with the purpose. Further, an appropriate plasticizer, an lubricant, etc. may be contained in the hydrophilic binder in accordance with the purpose.

The light-sensitive silver halide photographic material of this invention may be composed of a support laminated with various layers such as a emulsion layer, a filter layer, a intermediate layer, a protective layer, a subbing layer, a backing layer, an antihalation layer, etc.

The direct positive type light-sensitive silver halide photographic material of this invention may be applied for a colloid transfer process, a silver salt diffusion transfer process, a color image transfer process, a color diffusion transfer process, an absorption transfer process and the like as disclosed by H. G. Rogers in U.S. Pat. Nos. 3,087,817, 3,185,567 and 2,983,606; by W. J. Weyerts et al. in U.S. Pat. No. 3,253,915; by K. E. Whitmore et al. in U.S. Pat. No. 3,227,550; by C. R. Barr et al. in U.S. Pat. No. 3,227,551; by K. E. Whitmore in U.S. Pat. No. 3,227,552; and by E. H. Land in U.S. Pat. Nos. 3,415,644, 3,415,645 and 3,415,646.

This invention will be illustrated by the following Examples, which, however, should not be construed to restrict the embodiment of this invention.

EXAMPLE 1

An internal latent image type silver iodobromide (content of silver iodide:1.36 mole %) was prepared according to the following procedure. Into a 1.5% aqueous gelatin solution were simultaneously added an aqueous potassium bromide solution containing potassium iodide and an aqueous ammoniacal silver nitrate solution with stirring over 60 minutes, while controlling PAg to 10.3, pH to 10–11, and the temperature to 55° C. Upon completion of mixing, the mixture was then adjusted to pH 10 and subjected to physical ripening for 30 minutes, followed by water-washing. The iodobromide emulsion obtained was applied on a support of cellulose triacetate in an amount of 35 mg calculated as silver per 100 $cm^2$, and dried.

After thus prepared photographic film sample was exposed through an optical wedge for use of sensitometory by using an actinometer (hereinafter referred to as "wedge-exposure"), it was immersed in the undermentioned fogging bath at 20° C. for 1–6 minutes and further in a 3% aqueous solution of acetic acid, and washed with water. Subsequently, it was developed with the developer prescribed below, fixed in a usual manner, washed with water and dried.

Metol—2.5 g
L-ascorbic acid—10 g
$NaBO_2.4H_2O$—20 g
KBr—1 g
Water—to make 1 *l*

On the other hand, the exposed film was immersed in the undermentioned fogging bath B and treated further under the same conditions as described above, provided that the fogging bath A was prepared by dissolving 1 g of 1-formyl-2-phenylhydrazine in 1 l of water and by adjusting the pH value to 12.9 with NaOH, and the fogging bath B was prepared by adding 10 mg of trimethylamineborane per 1 *l* of the fogging bath A. The results each are shown in Table 1.

Table 1

| Time of immersion in fogging bath (min) | Fogging bath A (control) | | Fogging bath B | |
|---|---|---|---|---|
| | Maximum density | Minimum density | Maximum density | Minimum density |
| 1 | 0.08 | 0.07 | 0.18 | 0.07 |
| 2 | 0.14 | 0.07 | 0.32 | 0.07 |
| 3 | 0.27 | 0.07 | 0.45 | 0.08 |
| 4 | 0.34 | 0.09 | 0.67 | 0.09 |

Table 1-continued

| Time of immersion in fogging bath (min) | Fogging bath A (control) Maximum density | Fogging bath A (control) Minimum density | Fogging bath B Maximum density | Fogging bath B Minimum density |
|---|---|---|---|---|
| 5 | 0.42 | 0.10 | 0.74 | 0.10 |
| 6 | 0.48 | 0.10 | 0.78 | 0.10 |

From the above results, it is understood that a positive image having an increased maximum density and of good quality can be formed more rapidly by treating with the fogging bath B containing tert-butylamineborane.

EXAMPLE 2

The photographic film sample used in Example 1 was wedge-exposed and developed at 20° C. for 4 minutes and 30 seconds in the fogging developer prescribed below.

| | |
|---|---|
| phenidone | 0.4 g |
| sodium sulfite (anhydrous) | 75 g |
| hydroquinone | 10 g |
| sodium carbonate (monohydrate) | 40 g |
| KBr | 4 g |
| 5-methylbenztriazole | 10 mg |
| 1-formyl-2-phenylhydrazine | 1 g |
| Water | to make 1 *l* |

(The pH vale was adjusted to 12.9 with NaOH.) Then, the sample was fixed, washed with water and dried (Sample 1).

On the other hand, the exposed film was treated under the same conditions as mentioned above, except that 10 mg of trimethylamineborane was added to 1 l of the above-mentioned developer (Sample 2).

The results of the positive images thus obtained are shown in Table 2.

Table 2

| | Maximum density | Minimum density |
|---|---|---|
| Sample-1 (control) | 0.53 | 0.16 |
| Sample 2 | 0.87 | 0.17 |

EXAMPLE 3

To the silver iodobromide emulsion prepared in Example 1 was added 1 g of a fogging agent, 3-(2-acetylethyl)-2-methylbenzothiazolium bromide per 1 mole of silver. The thus prepared emulsion was applied on a support of cellulose triacetate film in an amount of 35 mg of silver per 100 cm$^2$, and dried. After wedge-exposure, the photographic film sample was developed at 20° C. for 4 minutes and 30 seconds in the following developer:

| | |
|---|---|
| Metol | 2 2 g |
| sodium sulfite (anhydrous) | 75 g |
| hydroquinone | 8 g |
| sodium carbonate monohydrate | 52 g |
| potassium bromide | 5 g |
| water | to make 1 *l* |

(The pH value was adjusted to 11.5 with NaOH.) Then, it was fixed, washed with water and dried (Sample 1).

On the other hand, the exposed film was treated under the same conditions as mentioned above, except that 2 mg of tert-butylamineborane was added to 1 l of the developer mentioned above (Sample 2).

The results of the positive images thus obtained are shown in Table 3.

Table 3

| | Maximum density | Minimum density |
|---|---|---|
| Sample-1 (control) | 0.65 | 0.13 |
| Sample -2 | 0.93 | 0.14 |

From the above results, it is shown that a good positive image having an increased maximum density can also be obtained in the presence of an amineborane compound when a fogging agent is incorporated into the emulsion.

EXAMPLE 4

To the silver iodobromide emulsion prepared in Example 1 was added a cyan coupler, 1-hydroxy-N-[δ-(2,4-t-amylphenoxy)-butyl]-2-naphthoamide which had been dissolved in tri-o-cresyl phosphate and dispersed in an aqueous solution of gelatin. The thus obtained emulsion was applied on a support of cellulose triacetate in an amount of 25 mg of silver per 100 cm$^2$ and dried. After wedge-exposure, the photographic film sample was developed at 20° C. for 3–5 minutes in the developer prescribed below.

| | |
|---|---|
| 4-amino-3-methyl-N-ethyl-N-(β-hydroxyethyl)aniline sulfate | 5 g |
| sodium sulfite (anhydrous) | 2 g |
| trisodium phosphate | 40 g |
| benzimidazole | 50 mg |
| 1-acetyl-2-phenylhydrazine | 1 g |
| water | to make 1 *l* |

(The pH value was adjusted to 12.9 with NaOH.) Next, the sample was bleached according to a usual method, fixed, washed with water and dried (Sample 1).

On the other hand, the exposed film was treated under the same conditions as mentioned above, except that 1 mg and 4 mg of tert-butylamineborane was added to 1 l of the developer mentioned above (Sample 2).

The results of each cyan positive images are shown in Table 4.

Table 4

| Development time (min.) | 3 | 4 | 5 |
|---|---|---|---|
| Sample-1 (Control) | | | |
| Maximum density | 1.90 | 1.96 | 2.08 |
| Minimum density | 0.10 | 0.10 | 0.11 |
| Sample-2 Amineborane(1 mg/l) | | | |
| Maximum density | 2.43 | 2.70 | 2.70 |
| Minimum density | 0.11 | 0.12 | 0.12 |
| Sample-3 Amineborane(4 mg/l) | | | |
| Maximum density | 2.73 | 2.75 | 2.79 |
| Minimum density | 0.30 | 0.45 | 0.53 |

From these results, it is recognized that the addition of tert-butylamineborane accelerates the development of positive image to increase the maximum density remarkably at an early state of the development. And 1 mg/l of addition of tert-butylamineborane gave a good positive image.

In cases where 3-(2-formylethyl)-2-methylbenzothiazolium bromide or spiro[benzimidazoline-2,1'-cyclohexane] is used in the developer in place of 1-acetyl-2-phenylhydrazine, further addition of tert-butylamineborane accelerates the development of positive image in the same manner to give a good positive image.

EXAMPLE 5

The photographic film sample used in Example 4 was developed, after wedge-exposure, at 20° C. for 5 minutes in the developer prescribed below.

| | |
|---|---|
| Sulfate of 4-amino-3-methyl-(β-hydroxyethyl)aniline | 5 g |
| sodium sulfite (anhydrous) | 2 g |
| trisodium phosphate | 40 g |
| benzimidazole | 50 mg |
| fogging agent | * |
| tert-amineborane | ** |
| water | to make 1 *l* |

*and** : as shown in Table 5

(The pH value was adjusted to 12.0 with NaOH.) Next, the sample was bleached, fixed, washed with water and dried in accordance with ordinary methods.

The results of the positive images thus obtained are shown in Table 5.

Table 5

| Developer | (Fogging agent) 1-Acetyl-2-phenylhydrazine (g/l) | t-Butylamineborane (mg/l) | pH of developer | [Positive image] Maximum density | Minimum density |
|---|---|---|---|---|---|
| A | 1.0 | 0 | 12.9 | 2.05 | 0.11 |
| | | | 11.5 | 1.33 | 0.10 |
| B | 0.25 | 0 | 12.9 | 1.85 | 0.10 |
| | | | 11.5 | 0.97 | 0.10 |
| C | 1.0 | 1 | 12.9 | 2.75 | 0.12 |
| | | | 11.5 | 2.18 | 0.11 |
| D | 0.25 | 1 | 12.9 | 2.48 | 0.11 |
| | | | 11.5 | 2.08 | 0.10 |
| E | 0 | 1 | 12.9 | Positive image | |
| | | | 11.5 | was not formed. | |
| F | 0 | 50 | 12.9 | Positive image fogged at above 2.8 on the whole | |
| | | | 11.5 | surface was not formed. | |

From these results shown above, it is understood that the combined addition of tert-butylamineborane makes it possible to use a fogging agent in a lower concentration and gives a good positive image at a lower pH value.

EXAMPLE 6

The emulsion film used in Example 4 was developed, after wedge-exposure, at 20° C. for 5 minutes in a developer having the same composition as in Example 4, except that triethylamineborane, pyridineborane, 2,6-lutidineborane or morpholineborane was added to the developer used in Example 4.

The results are shown in Table 6.

Table 6

| Developer | Amineborane compounds and their amount added | Maximum density | Minimum density |
|---|---|---|---|
| A | Triethylamineborane 10 mg/l | 2.35 | 0.11 |
| B | Pyridine . borane | 2.57 | 0.12 |
| C | 2,6-Lutidineborane | 2.46 | 0.12 |
| D | Morpholine . borane | 2.74 | 0.15 |

EXAMPLE 7

The process for forming a positive image according to this invention may be applied to a image transfer process. Silver halide emulsions having the following compositions were applied on a support of cellulose triacetate to prepare film samples.

Sample 1: The silver iodobromide emulsion (silver content: 13 mg/100 cm$^2$) prepared in Example 1 and containing a cyan image transfer coupler, dipotassium salt of 2-(3,5-disulfobenzamido)-4-(3-octadecylcarbamylthio)-5-methylphenol (10.8 g/l mole of silver) and a fogging agent, 1-formyl-2-phenylhydrazine (5 g/l mole of silver) was applied on a transparent triacetate base.

Sample 2: In the composition of Sample 1 mentioned above, the prescription of the fogging agent was changed as follows.

1-formyl-2-phenylhydrazine —0.5 g/l mole of silver
tert-butylamineborane —2 mg/l mole of silver Next, the film sample was developed, after wedge-exposure, with the following viscous developer:

| | |
|---|---|
| ascorbic acid | 0.4 g |
| 4-amino-N-ethyl-N-(β-hydroxyethyl)aniline | 10 g |
| benztriazole | 0.3 g |
| sodium hydroxide | 15 g |
| 4% high viscous aqueous solution of carboxymethylcellulose | 700 cc |
| water | to make 1 *l* |

according to a method in which a developer is introduced between a film sample and a image-receiving sheet containing a cationic mordant and pressed at 20° C. for 3 minutes. Subsequently, the image-receiving sheet was stripped to obtain a positive image on the image-receiving sheet as shown in Table 7.

Table 7

| | Maximum density | Minimum density |
|---|---|---|
| Sample - 1 | 1.75 | 0.24 |
| Sample - 2 | 2.05 | 0.23 |

From the results, it is shown that the process of this invention also is useful when a fogging agent is added to an emulsion.

Namely, it is shown that a good positive image can be formed by the addition of an amineborane compound in spite of the decrease of the amount of a fogging agent.

What is claimed is:

1. A process for forming a direct positive image by developing, after imagewise exposure of an internal latent image type light-sensitive silver halide photographic material, with a surface developer for silver halide, which comprises incorporating at least one fogging agent selected from hydrazine compounds, N-substituted cycloammonium salts and benzimidazole derivatives in combination with an amineborane compound into said light-sensitive silver halide photographic material, said surface developer or a treating bath used prior to the treatment by said surface developer.

2. The process for forming a direct positive image as claimed in claim 1 wherein said amineborane compound is represented by the formula:

$$Z{:}BH_3$$

wherein Z represents an alkylamine or a heterocyclic amine.

3. The process for forming a direct positive image as claimed in claim 2 wherein said alkylamine is represented by the formula:

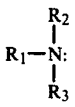

wherein $R_1$ represents an alkyl group having 1 to 20 carbon atoms or a hydroxyalkyl group;

$R_2$ and $R_3$ each represent an alkyl group having 1 to 20 carbon atoms, a hydroxyalkyl group or a hydrogen atom.

4. The process as claimed in claim 2 wherein said cyclic amine is pyridine, picoline, lutidine, 2-ethylpyridine, 2,4-diethylpyridine or morpholine.

5. The process as claimed in claim 1 wherein said amineborane is used in an amount of $10^{-5}$ to $10^{-1}$ mole per one mole of the fogging agent.

6. The process as claimed in claim 1 wherein said fogging agent is incorporated into a light-sensitive silver halide photographic material in an amount of 50 mg to 5 g per one mole of the silver halide.

7. The process as claimed in claim 1 wherein said fogging agent is incorporated into a surface developer or a treating bath used prior to the treatment by the surface developer in an amount of 0.1 to 3 g per one liter of a surface developer or a treating bath.

* * * * *